US007659816B2

(12) United States Patent
Wandel

(10) Patent No.: US 7,659,816 B2
(45) Date of Patent: Feb. 9, 2010

(54) METHOD AND A DEVICE FOR DETECTING INTRUSION INTO OR TAMPERING WITH CONTENTS OF AN ENCLOSURE

(75) Inventor: Sten Wandel, Lund (SE)

(73) Assignee: Secure Logistics Sweden AB, Lund (SE)

( * ) Notice: Subject to any disclaimer, the term of this patent is extended or adjusted under 35 U.S.C. 154(b) by 276 days.

(21) Appl. No.: 11/914,324

(22) PCT Filed: May 18, 2006

(86) PCT No.: PCT/SE2006/000570

§ 371 (c)(1),
(2), (4) Date: Nov. 13, 2007

(87) PCT Pub. No.: WO2006/123983

PCT Pub. Date: Nov. 23, 2006

(65) Prior Publication Data

US 2008/0252450 A1 Oct. 16, 2008

(30) Foreign Application Priority Data

May 18, 2005 (SE) ..... 0501109

(51) Int. Cl.
*G08B 13/00* (2006.01)

(52) U.S. Cl. ..... 340/541; 340/540; 340/572.1; 340/572.4; 340/572.8; 340/539.26; 73/146.2; 73/146.8

(58) Field of Classification Search ..... 340/541, 340/540, 572.1, 572.4, 572.8, 539.26; 73/146.2, 73/146.8

See application file for complete search history.

(56) References Cited

U.S. PATENT DOCUMENTS 4,391,203 A 7/1983 Millar (Continued)

FOREIGN PATENT DOCUMENTS

EP 0 421 590 A1 4/1991

(Continued)

OTHER PUBLICATIONS

Johnston, R.G., et al., The Efficacy of Tamper-Indicating Devices, Journal of Homeland Security, Apr. 16, 2002, http://www.homelandsecurity.org/journal/Articles/displayarticle.asp?article=50, Los Alamos National Laboratory, Los Alamos, NM.

(Continued)

*Primary Examiner*—Tai T Nguyen
(74) *Attorney, Agent, or Firm*—Fredrikson & Byron, P.A.

(57) ABSTRACT

A method and a device for detecting intrusion into or tampering with contents of an enclosure. According to the method at least one gas proof seal-barrier is provided in association with the enclosure and a first environment is produced within said gas proof seal-barrier. Said first environment is different regarding at least one characteristic feature from a second environment surrounding said gas proof seal-barrier. At least one detector is arranged within said gas proof seal-barrier for detecting a predetermined change of the characteristic feature of the said first environment. Said detector is transferred irrevocably from a first state to a second state when there is a predetermined change of the characteristic feature, and the state of the detector is supplied to a position outside said gas proof seal-barrier.

44 Claims, 2 Drawing Sheets

U.S. PATENT DOCUMENTS

| | | | | |
|---|---|---|---|---|
| 4,398,089 | A | 8/1983 | Sharpe | |
| 4,434,893 | A | 3/1984 | Barlow | |
| 4,436,203 | A | 3/1984 | Reyner | |
| 4,449,631 | A | 5/1984 | Levenberg et al. | |
| 4,653,643 | A | 3/1987 | Black | |
| 4,793,489 | A | 12/1988 | Israel | |
| 4,813,541 | A | 3/1989 | Velasco et al. | |
| 4,837,555 | A | 6/1989 | Millar | |
| 5,190,175 | A | 3/1993 | Schmidt | |
| 5,689,243 | A | 11/1997 | Bianco | |
| 6,394,022 | B1 | 5/2002 | Johnston et al. | |
| 6,553,930 | B1 | 4/2003 | Johnston et al. | |
| 6,588,812 | B1 | 7/2003 | Garcia et al. | |
| 7,392,694 | B2 * | 7/2008 | Morita et al. | 73/146 |
| 2002/0171547 | A1 | 11/2002 | Johnston et al. | |
| 2003/0160695 | A1 | 8/2003 | Hisano | |
| 2004/0041705 | A1 | 3/2004 | Auerbach et al. | |
| 2004/0041706 | A1 | 3/2004 | Stratmoen et al. | |
| 2004/0046660 | A1 | 3/2004 | Ando | |
| 2004/0174259 | A1 | 9/2004 | Peel et al. | |
| 2004/0178880 | A1 | 9/2004 | Meyer et al. | |
| 2004/0189466 | A1 * | 9/2004 | Morales | 340/539.26 |
| 2004/0233054 | A1 | 11/2004 | Neff et al. | |
| 2004/0233055 | A1 * | 11/2004 | Canich et al. | 340/539.26 |
| 2004/0263329 | A1 | 12/2004 | Cargonja et al. | |

FOREIGN PATENT DOCUMENTS

| | | | |
|---|---|---|---|
| EP | 0 627 363 | A1 | 12/1994 |
| EP | 0 637 551 | A1 | 2/1995 |
| EP | 1 079 221 | A1 | 2/2001 |
| WO | 94/08236 | A1 | 4/1994 |
| WO | 96/02438 | A1 | 2/1996 |
| WO | 96/12659 | A1 | 5/1996 |
| WO | WO 96/12659 | A1 | 5/1996 |
| WO | 99/60359 | A1 | 11/1999 |

OTHER PUBLICATIONS

Johnston, R.G., et al., Tamper-Indicating Seals for Nuclear Disarmament and Hazardous Waste Management, Science and Global Security, vol. 9, 2001, pp. 93-112, Overseas Publishers Association, Los Alamos National Laboratory, Los Alamos, NM.

Johnston, R.G., et al., Improved Security Via "Town Crier" Monitoring (The Correct Way to do Cargo Security), Proceedings of Waste Management '03, Feb. 23-27, 2003, Phoenix, AZ.

Johnston, R.G., et al., The 'Town Crier' Approach to Monitoring, International Journal of Radioactive Materials Transport vol. 13, No. 2, 2002, pp. 117-126, Los Alamos National Library, Los Alamos, NM.

Johnston, R.G., et al., An Annotated Taxonomy of Tag and Seal Vulnerabilities, Journal of Nuclear Materials Management, vol. 28, Spring 2000, pp. 23-30.

Johnston, R.G., et al., Vulnerability Assessment of Passive Tamper-Indicating Seals, Journal of the Institute of Nuclear Materials Management, US, vol. 23, No. 4, Jul. 1995, pp. 24-29.

Black, B.D., Survey of High Security Tamper-Indicating Enclosures, Nuclear Materials Management, Annual Meeting Proceedings, US, vol. 20, believed to be available more than 1 year prior to the effective filing date of instant application, pp. 775-780.

Johnston, R.G., et al., New Approaches to Tamper and Intrusion Detection for Safeguards and Transport Security, LAUR-03-3766, INMM Proceedings, Jul. 13-17, 2003, Phoenix, AZ.

Johnston, R.G., Tamper-Indicating Seals: Practices, Problems, and Standards, Paper for the World Customs Organization Security Meeting, Los Alamos Laboratory Report LAUR-03-0269, Feb. 11-14, 2003, Brussels, Belgium.

Warner, J.S., et al., A Simple Demonstration that the Global Positioning System (GPS) is Vulnerable to Spoofing, Los Alamos National Laboratory Report LAUR-03-2384.

Johnston, R.G., MagTag: Magnetic Vector Field Tag and Seal, Los Alamos National Laboratory Report LAUR-02-6848.

Johnston, R.G., Magic Slate Seal, Los Alamos National Laboratory Report LAUR-02-6848.

* cited by examiner

METHOD AND A DEVICE FOR DETECTING INTRUSION INTO OR TAMPERING WITH CONTENTS OF AN ENCLOSURE

RELATED APPLICATIONS

This application claims priority to International Application No. PCT/SE2006/000570 filed May 18, 2006 and to Swedish Patent Application No. 0501109-3 filed May 18, 2005, the teachings of which are incorporated herein by reference.

TECHNICAL FIELD

The invention relates to a method and a device for detecting intrusion into or tampering with contents of an enclosure, such as a container or a package. When storing and transporting goods it is in many cases essential to be able to detect whether a container has been opened or tampered with. Tamper-indicating devices ("seals") have many important security applications, including counter-terrorism, cargo security, law enforcement, nuclear safeguards, and protecting against product tampering.

Tamper-indicating devices are designed for detecting unauthorized access, entry, or tampering. Tamper-indicating devices are widely used for a variety of government and private sector applications. These include access control to: containers, ballot boxes, cabinets, safes, and vaults; cargo security; inventory control; banking records and money instruments; courier services and diplomatic mail; integrity of documents and records; customs: detect smuggling of contraband; law enforcement; hazardous materials accountability; nuclear safeguards and non-proliferation treaty monitoring; counter-espionage; counter-terrorism; physical computer security; and preventing utility theft by tampering with utility meters. Tamper-indicating devices are also commonly used to protect food, drink, and pharmaceutical products from tampering and being replaced by counterfeits. They can help guarantee instrument calibration and the sterility of medical supplies, as well as assist in maintaining a chain of custody for forensics and law enforcement evidence.

PRIOR ART

Tamper-indicating devices are frequently called "tamper indicators", "tamper-indicating seals", "security seals", or just "seals". They take a variety of forms. Seals can be frangible foils or films, plastic wraps, pressure-sensitive adhesive tapes, crimped cables or other (theoretically) irreversible mechanical assemblies; security containers or enclosures that give evidence of being opened; devices or materials that display irreversible damage or changes when manipulated; electronic or electro optic devices and systems that continuously monitor for changes, such as a break in an electrical cable or fiber-optic bundle; and other devices that are intended to display irreversible damage or change when manipulated.

A seal is said to have been defeated when it has been opened and then resealed without being detected, e.g. by using a counterfeit seal or repairing the original. Attacking a seal means undertaking a series of actions intended to defeat the seal.

Seals differ from locks in that they are intended to leave unambiguous and non-erasable evidence of tampering and unauthorized access, rather than impeding or delaying access. Said evidence(s) are stored in or on the seal until it is inspected, either manually or electronically. However, an adversary can usually erase said evidence(s) with little difficulty. Seals differ from intrusion ("burglar") alarms in that unauthorized access or entry normally is not reported immediately. This has both advantages and disadvantages. One drawback is that the seal as such does not take into account any time aspects. It is for instance not possible to detect at what time a break of the seal occurred.

Several types of electrochemical sensor have been developed to detect analyt disposed in the atmosphere as described in PCT/GB95/01662. They may be impedometric, amperometric, potentiometric or condictometric. Examples of suitable gases are oxygen, carbon dioxides, hydrogen sulphides, ethanol, alkyd sulphide, ketones, esters, ammonia or amines. The sensors can be manufactured by Screen printing, lithographic or thick film deposition processes, for example as disclosed in PCT/GB93/02076. These are inexpensive. Conductive polymers such as polypyrole, polyaniline or plythiophene may be employed as described in PCT/BG95/01662. The conductance of these materials changes due to absorbtion of analytes such as ammonia and other nitrogen containing molecules. pH can be measured using a proton reversible reference electrode material.

U.S. Pat. No. 4,793,489 discloses a tamper resistant package and a method for detecting tampering with a packaged product. The tamper resistant package has an inaccessible aerobic atmosphere indicator in the form of an incandescent filament. Specifically, the package comprises a container having an access opening, a first interior compartment for product storage exposed to the access opening, a second interior compartment isolated from the opening, and a lid adapted to seal the access opening. An aerobic atmosphere indicator is disposed in the second compartment. The response of the indicator can be observed on the exterior of the container.

To activate the indicator and test the package in accordance with U.S. Pat. No. 4,793,489 for tampering before opening, an electric current is passed through the filament. If the atmosphere in the package is aerobic, the filament will oxidize, preferably to the point of disintegration. Operation is therefore fail-safe in the sense that the filament glows steadily only if the indicator is operative and the integrity of the package has not been violated. If either of these conditions is not met, the package tests positive, thereby warning the consumer against use of the product. A drawback with the package in accordance with U.S. Pat. No. 4,793,489 is that the non aerobic atmosphere can be restored after an unauthorized access has occurred. When the status of the package is checked it can not be ensured that the seal has not been broken and then restored. Further deficiencies are that the seal has to be manually inspected by the eye of a human who could be bribed and that the time of the actual breach is not recorded.

Another angle of approach is to secure walls and doors of the container as a perimeter protection, so as to detect any attempts to provide access into the container. In many prior art systems seals are used on doors and electric or optic wires are provided in the walls in a mesh-like configuration. If any wire is broken an intrusion alarm can be given. A drawback with perimeter protection is that the perimeter of a container cannot be completely protected, e.g. against a hypodermic needle, and that they are rather expensive.

An object of the invention is to provide both a seal and alarm type of protection resulting in an improved tamper indication system. A further object of the invention is to ensure detection of all types of intrusions from any side wall or door of the container. Neither the size nor the position of the breakage or opening in the seal affects the function of the claimed invention. An embodiment of the invention will allow detection and registering attempts to defeat the seal by tampering with the tamper indicating system itself.

The present invention provides a tamper and intrusion indication method and device which overcomes the above mentioned deficiencies of prior art and provides additional novel features and advantages, and a wider range of uses than were possible with devices used heretofore.

SUMMARY OF THE INVENTION

In accordance with the invention there is provided a method for detecting intrusion into a container or manipulation with the detecting device itself. When a break of a seal or an enclosure of the container is done a detector is forced to enter irrevocably a state indicating that a break of the seal has occurred. The state of the detector is transferred to a communications unit associated to the detector and arranged outside the container. The container or enclosure can have very different appearances including, but not limited to, boxes, cans, bottles, bags, freight containers and envelopes. The method and the device in accordance with the invention can be used also in stationary applications, such as cabinets, safes, vaults or double walled shells around objects.

The inner cavity of the container is separated from the outside atmosphere by a gas proof seal-barrier, which can but does not need to be a different physical entity than the container itself. An atmosphere or environment having at least one characteristic feature is created within the sealed cavity and a detector or indicator sensitive to the characteristic feature is enclosed in the cavity. The cavity of the container may contain goods that need protection or it can be an empty container that needs protection from someone placing things into it, including, but not limited to, contraband or weapons for mass destruction. The detector can be provided with means for communicating with a communications unit arranged outside the seal and optionally outside the container. The communications unit can be, but is not limited to, a portable unit that at any arbitrary time is positioned and set up for communicating with the detector if the detector has detected a perceptible change of the characteristic feature of the inner atmosphere.

In some embodiments the detector includes a timing means such as a timer or a clock that is started, stopped or adjusted when the detector detects a change of the feature. When reading the timing means it is possible to detect at what time the container was opened. Preferably, the timing means cannot be reset, restarted or altered when once started or stopped to ensure that the timing information is maintained as unambiguous and non-erasable evidence of the intrusion event.

Within the seal-barrier in the container there is provided an inner atmosphere or environment having at least one feature that is different from the normal environment surrounding the container, the outer atmosphere. Any rupture in the seal-barrier results in some mixing of the two atmospheres and thereby changes of the properties of both atmospheres. One or both of these changes are used for detecting the rupture in the seal-barrier. In many applications it is sufficient to evacuate part of the air in the container or alternatively increase the air pressure. The seal is gas-proof and if the seal is opened or damaged the pressure in the container will change to the ambient pressure. The detector in such a case is designed to detect the change of air pressure.

The atmosphere within the seal can also be more complex and include one or more chemical substance(s). The detector(s) is set to detect a change of the concentration or the amount of these chemical substance(s) occurring when the seal is broken. The substance can be in gas form, liquid form or an aerosol. One or several of the substances can be radioactive.

The inner atmosphere is dispensed into the interior of the enclosure before the seal is closed, or afterwards, from one or more dispensers placed in the interior before it is sealed or through a valve in the barrier. In the latter alternative a hose connected to a vacuum pump, air pump or gas canister is used, or the whole enclosure is placed in a chamber filled with the desired inner atmosphere where it is sealed. This could preferably be an integral part of the packaging line.

In a simple embodiment the characteristic feature is a sufficiently lowered air pressure or vacuum and the detector comprises a pressure switch or a similar pressure-sensing device with a switch that is open (or closed) when the pressure within the container increases above a preset value. The switch is connected to an electrically operated time keeping device such as a watch. Either the time keeping device starts when the container is evacuated and then stops when the pressure detector opens the switch, or the time keeping device is initially turned off and then starts when a change in the atmosphere is detected. In either way the time keeping device carries timing information sufficient to determine when the container was opened or tampered with.

In general, a switch is connected to a recording device such as a timing means and a communicating means such as a radio transceiver. The communicating means can be designed to transmit a signal indicative of the opening of the container immediately, after a delay or when interrogated. As the detector, the timing and event recording means as well as the communicating means are all enclosed within the seal, the tamper indicating system protects it selves. The communications means preferably communicates using a wireless link including, but not limited to, electromagnetic waves, sound waves or particle beams.

The communicating means may be, but is not limited to, a Radio Frequency Identification (RFID) tag that is activated and energized by a radio frequency interrogation signal. When activated the RFID tag transmits a signal consisting of the information stored in the memory of the tag. The information may include information serving as an identification of the container as well as the status of the seal detector. By reading the tag at each hand over of custody or at regular intervals, it is possible to register the time interval when an intrusion has occurred. If the time intervals are very short a continuous surveillance is achieved. An advantage of using a passive RFID tag is that no battery or other power supply is required.

In some application it is useful to be able to read the tamper status without a separate reader. The inner sensor itself can then have a display—indicating if it has been tampered with or not—that is visible from the outside through a window of transparent material. If an outer sensor is used with a display it has to be connected, wired or wireless, to the inner sensor and have some built in logic. The display may be constructed so it can be read both by the human eye and automatically by an auto ID reader for OCR (optical character reader), optical bar code, infrared, or RFID and for example by adding one or a few bits to the ID code of the package.

In a simple embodiment of the invention, two RFID tags are placed inside the sealed cavity. The antenna of one of them is opened (or shortened, depending on the detailed characteristics of the tag) when the detector registers a break of the seal barrier. Hence, when both tags respond with their ID numbers when interrogated, the seal is unbroken. But if only one responds, the seal is broken.

In accordance with the invention it is possible also to design the communicating means to transmit continuously or intermittently when the detector has detected an intrusion. By communicating using e.g. available radio based networks, including, but not limited to, wireless LANs, mobile land and/or satellite based telephony systems etc., a signal indicative of the intrusion can be transmitted over significant distances and received and recorded in a central surveillance system. Alternatively, it transmits at preset times a signal, which may be coded and/or encrypted, indicating that the seal is unbroken. When one or several expected signals are missing or having the wrong code, the surveillance system notes that the container has been opened, tampered with or stolen.

BRIEF DESCRIPTION OF THE DRAWINGS

In order that the manner in which the above recited and other advantages and objects of the invention are obtained will be readily understood, a more particular description of the invention briefly described above will be rendered by reference to specific embodiments thereof which are illustrated in the appended drawings.

Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
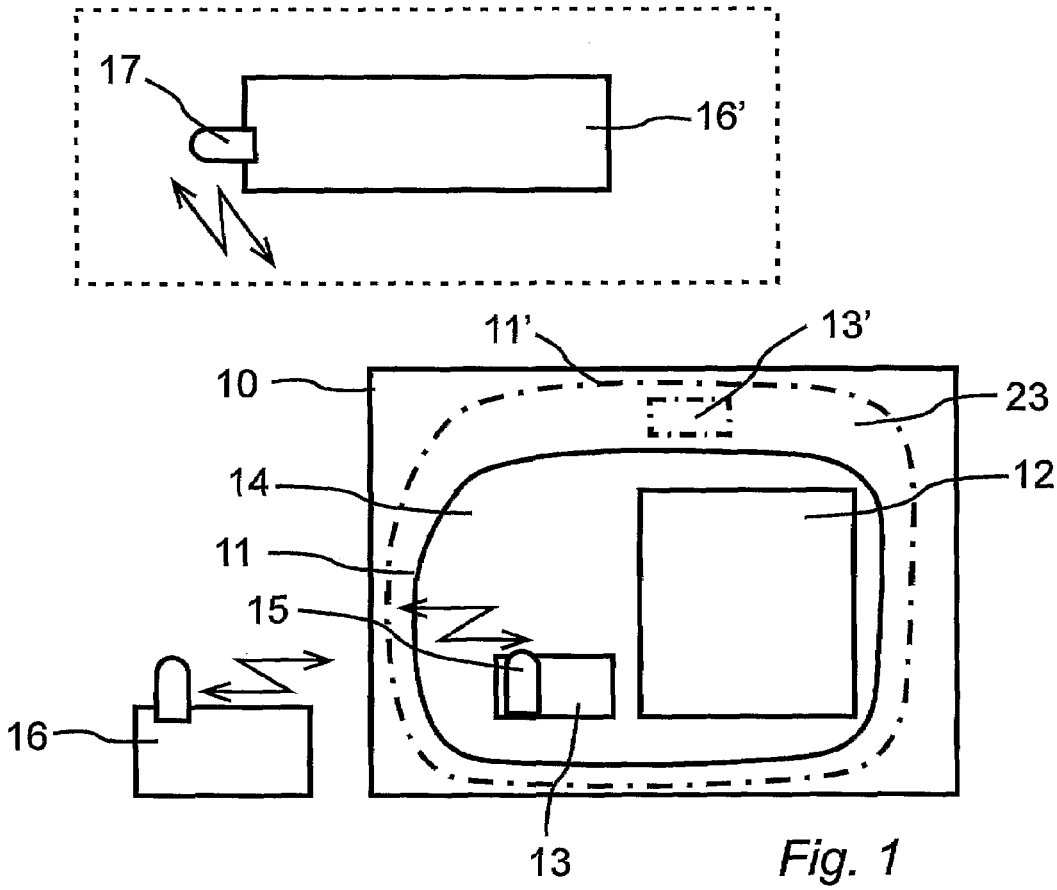
FIG. 1 shows schematically elements of a basic embodiment in accordance with the invention.

The embodiment shown in FIG. 1 comprises a container 10 and a barrier 11 enclosed in the container. The barrier 11 is gas-proof and encloses an inner cavity 14. Inside the gas-proof barrier there is provided an inner atmosphere or environment having at least one feature that makes the inner environment different from any surrounding environment outside the container 10. Articles or goods 12 may be arranged in the space 14 within the barrier in the container or the space may be empty. In the space 14 there is provided also a detector 13. The detector 13 has a sensor or indicator sensitive to alterations of the characteristic feature(s) of the inner atmosphere in 14.

The status of the detector can be observed in different ways. In a very simple embodiment in accordance with the invention a time stamp is recorded when the detector is affected by the change of the characteristic feature. The time stamp can be checked at the time of opening the container and after breaking the seal.

In another embodiment the detector comprises a communication unit 15 capable of transmitting a signal indicative of the status of the detector to the outside of the barrier 11 and preferably to the outside of the container 10. In such an embodiment the device in accordance with the invention comprises also an external communicating unit 16. The external communicating unit 16 can be a portable or fixed device that continuously, periodically or when appropriate is activated to receive (and optionally transmit) a signal from the internal communicating unit 15.

In one embodiment the external communicating unit 16 is designed to send a radio signal to the communication unit 15. The radio signal is received by the communication unit 15 and the energy received is sufficient to activate and energize the communication unit 15 so as to allow it to respond to the external communicating unit 16. The respond can be a radio signal including identification data and other relevant data from the detector 13, such as a time stamp indicative of the actual time when the barrier was breached. In this embodiment the communication unit 15 can be a RFID tag.

The communication between a passive RFID tag in the detector and the external communicating unit 16 can only take place within limited distances. If communication over larger distances is desired the communication unit 15 comprises a power supply and a radio system operating at larger distances, such as Bluetooth, WiFi, cellular telephone, UWB, satellite or other system. In such systems continuous surveillance is possible and an alarm signal can be transmitted from the communication unit 15 of the detector 13 whenever the seal barrier is broken or an OK signal at regular intervals as long as the seal is unbroken. The communication between units 15 and 16 preferably operates without galvanically connected wires and may include means for communicating with electromagnetic waves, particle rays or sound.

It is possible also to include at least one further barrier 11' enclosing the whole or part of the seal barrier 11 as well as providing a second sealed intermediate space 23. In said space 23 another gas, atmosphere or other medium having a detectable feature can be provided. There can be provided also a further detector 13' set to detect a change of said feature occurring when either the outer barrier 11' or the original barrier 11 is broken.

In a simple embodiment the barrier 11 is a plastic gas tight bag and the space 14 is partially evacuated and the detector 13 is a pressure switch. A lower pressure thus is created in the space 14 with a vacuum pump. If the barrier 11 is penetrated air enters into the space and the detector will respond to the rising pressure. The detector shown in FIG. 2 includes a gas-proof compartment 18 and a membrane 19. A first part of a switching element 20 is attached to the membrane 19 and a second part of the switching element 20 is fixedly mounted outside the compartment 18.

Figure 2:
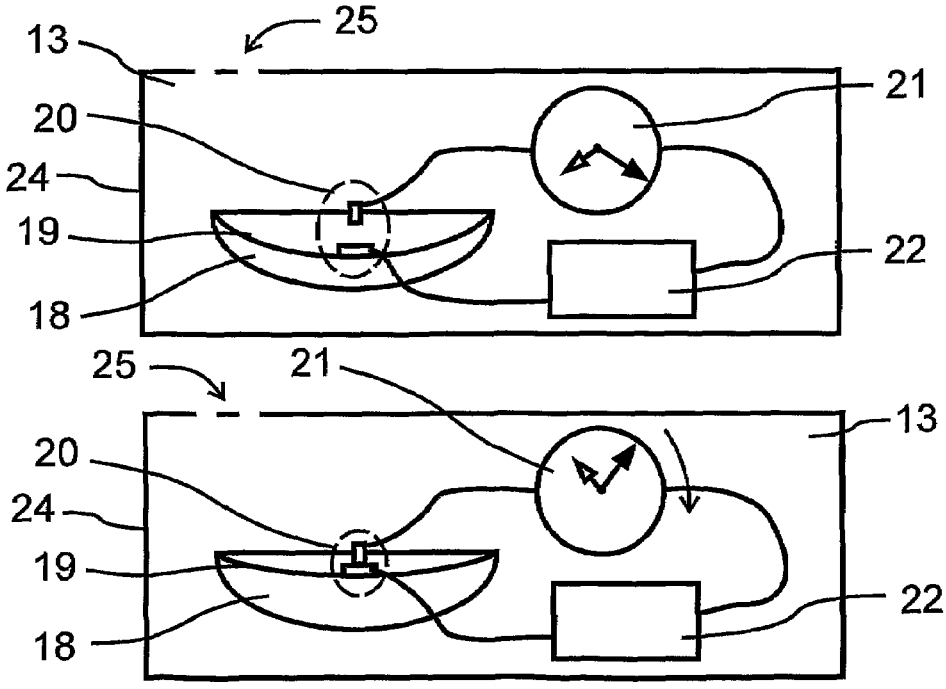
FIG. 2 shows schematically a basic embodiment of a detector in accordance with the invention.

In the embodiment shown in FIG. 2 the detector comprises a conventional electric time keeping device 21 such as an analogue wrist watch that also shows the date and a power supply 22 such as a conventional battery or a capacitor. The clock 21 is set at a predefined time e.g. Greenwich Time plus a preset time period, e.g. 2 minutes. The barrier is sealed, e.g. by a zipper. After 2 minutes some of the air in the enclosure has been evacuated, e.g. through a one way valve.

The detector 13 includes a cover 24 having openings 25 maintaining the same conditions within the detector as outside the detector in the space 14. When the pressure switch is produced the gas-proof compartment 18 is evacuated and the pressure therein is used as a reference pressure value. The membrane 19 assumes the position shown in the upper part of FIG. 2 if the detector 13 is positioned in a space having normal or a raised pressure. In this position the switching element 20 is open and no power is supplied to the clock 21.

Then the space 14 within the barrier 11 is evacuated and the membrane moves to the position shown in the lower part of FIG. 2. In this position the switching element 20 is closed and power is supplied to the clock 21, and the clock starts running. Preferably the clock is set to a standard time such as Greenwich Mean Time. The container 10 now can be stored or transported.

If the container is tampered with and the enclosing barrier 11 is penetrated air will enter into the space 14 and the switching element 20 will again be forced into an open position as shown in the upper part of FIG. 2 and no power will be supplied to the clock 21. The clock then stops and the time of the clock is an indication of when the barrier was broken.

When the package/container reaches its destination it is opened. If the clock then is showing Greenwich Mean Time the enclosure has been sealed all the time since it was packed. If not an investigation could start. The time of the clock shows when the intrusion or unintended leakage occurred. By checking the track record of the package using its ID number or similar data, the place and persons responsible can be investigated and video tapes and other surveillance documentation can be analysed. Other starting times or time schedules can be used in different applications. Preferably the clock is sealed so as to prevent manipulation of the time stamp after the intrusion occurred.

Figure 3:
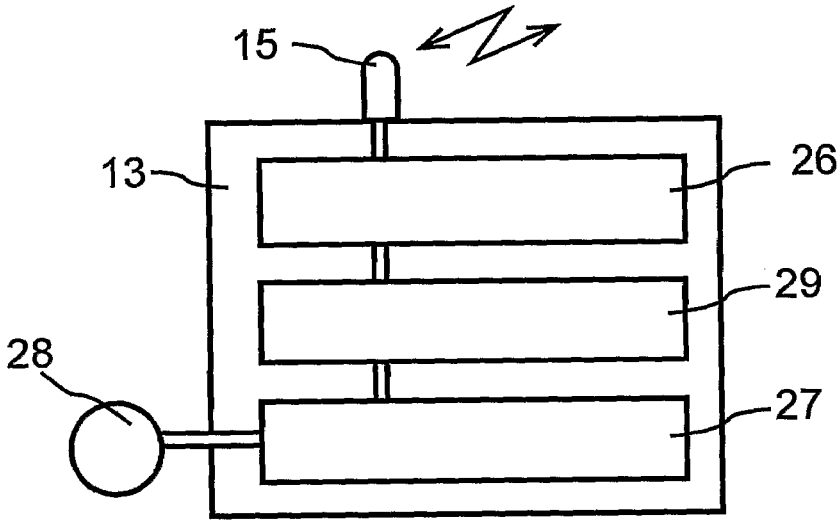
FIG. 3 is a block diagram showing an embodiment of a detector in accordance with the invention.

The detector can be modified to include also a memory unit 26, as shown in FIG. 3 that can be used to store time stamps of relevant events related to a change of the characteristic feature in the space 14. An investigation at a later time can show at what times the barrier was opened, closed or manipulated. For security reasons the content of the memory unit can be encrypted. It is possible to include in the detector also a processing unit 27 that is connected to a sensing element 28. The processing unit 27 can be used to filter out false alarms, e.g. slow changes in the pressure of the inner atmosphere. This may be due to large changes in the pressure of the outer atmosphere because the flexibility of the barrier will allow some changes in the volume of the inner atmosphere, e.g. when transported in an airplane without a pressure carbine. The slow changes may also be caused by a very small and harmless hole in the barrier. The electric clock is replaced by a clock circuit 29 delivering all necessary timing data.

Figure 4:
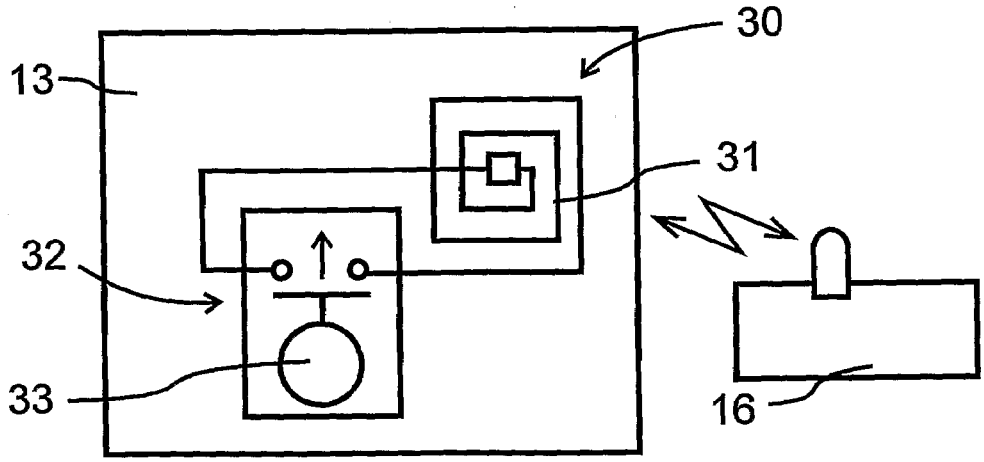
FIG. 4 shows schematically an alternative embodiment of a detector in accordance with the invention.

In some applications it is not necessary to determine the exact time when an intrusion or intrusion attempt was made. An embodiment of the invention suitable in such an application is shown in FIG. 4. In this embodiment detector 13 comprises an RFID tag 30 with an antenna circuit line 31. A switching element 32 of a sensing means 33 is included in line with the antenna circuit line 31. In a storing or transporting mode the switching element 32 is closed and communication between the detector 13 and a communicating unit 16 is enabled.

When the detector detects a change of the characteristic feature, such as the pressure within the seal, the switching element opens the antenna circuit line and no communication with the RFID tag is possible. For RFID tags operating at high frequencies, it is preferred that the antenna circuit is shortened instead of opened by the switching element 32. By reading the tag at each hand over of custody or at regular intervals it is possible to register the time interval when the intrusion occurred. If the time intervals are very short a continuous surveillance is achieved.

The RFID tag 30 can be replaced with any wireless communication unit. The principle is the same; the switching element 32 disables the communication of the wireless unit.

In many applications it is convenient to use air pressure or existence or concentration of a gas within the seal. The absolute amount of one of the gases in air can be detected by many types of indicators and sensors, e.g. electrochemical sensors, conductive polymers, thick film technology sensors, or thin film technology sensors. It is possible to use also Piezoelectric sensors. For gases the mixture can be defined by the set of partial gas pressures of each gas substances used.

The sensing media of the inner atmosphere may consist of a single chemical substance in gas or liquid form, e.g. nitrogen, carbon dioxide, water or oil, or a mixture of several substances in the form of gas, liquid or aerosol. The inner atmosphere can consist of a single gas substance added to air at atmospheric pressure. It is possible that the whole inner atmosphere is in liquid form, where the mixture can be defined by the set of mole weights for each liquid. Aerosols can also be used. In that case the mixture can be defined by the set of parts per million of each aerosol substance used.

Any combination of the sensing media described above can be used to detect tampering.

Stealing or making false enclosures with inner atmosphere and sensors can be detected by using a unique atmosphere mixture for each individual enclosure and register the atmosphere parameters, a seal code, together with the ID nr of the enclosure in a database of the surveillance system. Authentication is then done by reading both the seal code (as registered by the sensors) and the ID nr (registered by the reader) and check in the database if they match.

The sensing media can be directed into the inner atmosphere in different ways. One way is to dispense it into the interior of the enclosure before the barrier is sealed or afterwards from one or more dispensers placed in the interior before it is sealed or through a valve in the barrier. In the first alternative a hose connected to a vacuum pump, air pump or gas canister is used, or the whole enclosure is placed in a chamber filled with the desired inner atmosphere where it is sealed. This could preferably be an integral part of a packing line.

In accordance with one aspect of the invention transport packages can be provided with built-in gas tight liners and/or detectors, e.g. ISO containers that are specially built or retrofitted to be permanently gas tight or were each container wall is made with double gas tight walls and each wall has its own detector.

In another embodiment gas tight document poaches are used. A small detector is attached to the inside of the document. A trace gas is used as detecting media. The trace gas is provided through a small canister that is attached to the detector and broken when the poach has been sealed.

In use detectors owned by a first party are mounted in accordance with the invention in transport packages owned by a second party. The first party arranges for a global net to send detector status in real time or near real time to a computer system of the second party. In this solution it is possible for the first party to charge for any preferred level of visibility of the status of the detector and also for different levels of service. Different charges apply depending on how frequent the status is checked, every 5 minutes, every hour, every time the package is moved, each time it passes a terminal at each hands over of responsibility. It is possible also to apply different charges depending on what other status data that is provided: positioning with (GPS, Mobile net, WLAN), temperature, shocks, altitude, moister, door openings, radioactive emissions etc.

By including one or a plurality of the following services the first party may charge different amount. The services may be adapting, installing, performing service of, maintenance of, upgrading, disposing, reusing components of the system. In other applications the detectors are leased or purchased by the second party.

In accordance with the invention the second party can be or include the owner of the product that needs protection, the sender (shipper), the receiver (consignee), the forwarder, the transport operator, the terminal operator, the insurance company, the certification control company, police or customs authority. Where the detectors are owned by an insurance company it may be required by the insurance company that detectors and appropriate peripheral equipment are installed in transport packages in order to obtain a lower insurance fee. The second party in this case normally doesn't pay anything but get a discount on the insurance fee.

In accordance with a further aspect of the invention one party may install detectors and any required peripheral equipment in order to assess the quality of subcontractors, such as transport agencies or terminal operators.

Preferably detectors, liners and packages are disposable, so as to ensure that these components are not tampered with before being used.

It is possible also to provide gas proof seal-barriers in walls of an enclosure and thereby to protect major sections of an enclosure. Corners and other sections that are not covered by the seal-barriers can be protected by providing electric or optical wires in these sections. If any wire is broken an intrusion alarm can be given, even if the seal-barriers are not penetrated. An intrusion alarm can be given also when some of the seal-barriers are penetrated, even if no wire is broken.

While certain illustrative embodiments of the invention have been described in particularity, it will be understood that various other modifications will be readily apparent to those skilled in the art without departing from the scope and spirit of the invention. Accordingly, it is not intended that the scope of the claims appended hereto be limited to the description set forth herein but rather that the claims be construed as encompassing all equivalents of the present invention which are apparent to those skilled in the art to which the invention pertains.

The invention claimed is:

1. A method for detecting intrusion into or tampering with contents of an enclosure, characterised by providing at least one gas proof seal-barrier in association with the enclosure, producing a first environment within said gas proof seal-barrier, said first environment being different regarding at least one characteristic feature from a second environment surrounding said gas proof seal-barrier, arranging at least one detector within said gas proof seal-barrier for detecting a predetermined change of the characteristic feature of the said first environment, transferring irrevocably said detector from a first state to a second state when there is a predetermined change of the characteristic feature, and supplying the state of the detector to a position outside said gas proof seal-barrier.

2. A method in accordance with claim 1, also including the step of observing said state in a communicating unit arranged outside said gas proof barrier.

3. A method in accordance with claim 1, also including the step of registering and storing within said gas proof seal-barrier one or several time stamp(s) indicating at least when the change(s) have occurred

4. A method in accordance with claim 1, where the storing and/or the communication is encrypted.

5. A method in accordance with claim 1, where the time stamps are analysed to filter out false alarms, for example but not limited to slow changes due to an insignificant small hole in the barrier or to a slight volume change of the container due to a large change of the pressure of the outer atmosphere.

6. A method in accordance with claim 1, also including a second or several additional gas proof barrier(s), partly or completely enclosing the first gas-proof barrier and producing characteristic inner environment(s) within each said barrier with at least one characteristic feature that differs from its immediately surrounding outer environment and arranging additional detectors at least within every second environment.

7. A method in accordance with claim 1, also including a second or several additional detectors for detecting changes in the characteristics of each environment.

8. A method in accordance with claim 1, also including a second or several additional detectors for detecting differences among any pair of environments, for example but not limited to relative pressure.

9. A method in accordance with claim 1, where one or several environment(s) consist of substances in gas form as a sensing media.

10. A method in accordance with claim 1, where one or several environment(s) consist of liquid substances as a sensing media.

11. A method in accordance with claim 1, where one or several environment(s) contains aerosols as a sensing media.

12. A method in accordance with claim 1, where one or several of the substances in the environment(s) are radioactive as a sensing media.

13. A method in accordance with claim 1, where at least two sensing medias from the group consisting of radioactive substances, aerosols, substances in gas form, substances in liquid form are used in combination.

14. A method in accordance with claim 1, where one or several environment(s) are made unique for each individual enclosure by mixing several substances in a unique recipe, a "seal code", and these seal codes are stored together with an identification number of the enclosure in a database for later authentication purposes.

15. A method in accordance with claim 1, also including the step of producing an electro magnetic signal indicative of the change of the characteristic feature.

16. A method in accordance with claim 1, also including the step of producing an acoustic signal indicative of the change of the characteristic feature.

17. A method in accordance with claim 1, also including the step of producing a signal using radioactive particle radiation indicative of the change of the characteristic feature.

18. A method in accordance with claim 1, also including the step of transmitting an interrogation signal to any said detector, to enable it to transmit a signal indicative of the state of the detector.

19. A method in accordance with claim 1, also including the step of remotely energizing said detector to enable it to communicate its state information to communicating device(s) outside its enclosing gas proof barrier.

20. A method in accordance with claim 1, also including the step of disabling the detector from communicating its state when there is a change in the characteristic feature.

21. A method in accordance with claim 1, where the enclosure is selected from a group comprising but not limited to an envelope, bag, can, bottle, package, box, container, safe, vault or a shell with double walls around an object.

22. A device for detecting intrusion into or tampering with contents of an enclosure, characterised in that the enclosure is provided with at least one gas proof seal-barrier enclosing an environment, said first environment being different regarding at least one characteristic feature from a second environment surrounding said gas proof seal-barrier, that at least one detector is provided within said gas proof seal-barrier that the detector is arranged to switch from a first state to a second state when there is a predetermined change of the characteristic feature of the said first environment, and that the detector is provided with means for supplying the state to a location outside the gas proof seal-barrier.

23. A device in accordance with claim 22, wherein the detector is connected to communicating means for communicating a signal indicative of the change of state of the detector, and an external communicating unit is provided exterior of the gas proof seal-barrier for receiving said signal.

24. A device in accordance with claim 22, also including timing means for recording and storing within said gas proof seal-barrier of one or several time stamp(s) indicating at least when the change(s) occurred.

25. A device in accordance with claim 22, wherein the storing and/or the communication also is encrypted.

26. A device in accordance with claim 22, wherein the time stamps also are analysed to filter out false alarms, for example but not limited to slow changes due to an insignificant small hole in the barrier or to a slight volume change of the container due to a large change of the pressure of the outer atmosphere.

27. A device in accordance with claim 22, also including a second or several additional gas proof barrier(s), partly or completely enclosing the first gas-proof barrier and producing characteristic inner environment(s) within each said barrier with at least one characteristic feature that differs from its immediately surrounding outer environment and arranging additional detectors at least within every second environment.

28. A device in accordance with claim 22, also including a second or several additional detectors for detecting changes in the characteristics of each environment.

29. A device in accordance with claim 22, also including a second or several additional detectors for detecting differences among any pair of environments, for example but not limited to relative pressure.

30. A device in accordance with claim 22, where one or several environment(s) consist of substances in gas form as a sensing media.

31. A device in accordance with claim 22, where one or several environment(s) consist of liquid substances as a sensing media.

32. A device in accordance with claim 22, where one or several environment(s) contains aerosols as a sensing media.

33. A device in accordance with claim 22, where one or several of the substances in the environment(s) are radioactive as a sensing media.

34. A device in accordance with claim 22, where any combination of the sensing medias above are used.

35. A device in accordance with claim 22, where one or several environment(s) are made unique for each individual enclosure by mixing several substances in a unique recipe, a "seal code", and these seal codes are stored together with an identification number of the enclosure in a database for later authentication purposes.

36. A device in accordance with claim 22, wherein the means for communicating the state of the detector comprises an electro magnetic transmitter.

37. A device in accordance with claim 22, wherein the means for communicating the state of the detector comprises an acoustic transmitter.

38. A device in accordance with claim 22, wherein the means for communicating the state of the detector comprises a device that transmits radioactive particles.

39. A device in accordance with claim 22, wherein the external communications unit comprises means for transmitting an interrogation signal to any said detector, to enabled it to transmit a signal indicative of the state of the detector.

40. A device in accordance with claim 22, wherein the detector comprises the means for being partly or fully energized by an energy source external to the gas-proof barrier(s) to enable it to communicate its state information to communicating device(s) outside its enclosing gas proof barrier.

41. A device in accordance with claim 22, wherein the means for communicating the state of the detector is disabled when there is a change of the characteristic feature.

42. A device in accordance with claim 22, where the enclosure is selected from a group comprising but not limited to envelope, bag, package, box, container, safe, vault or a shell with double walls around an object.

43. A device in accordance with claim 22, where gas proof seal-barriers are provided in walls of the enclosure and where electric or optical wires are provided in corners and other sections that are not covered by the seal-barriers, the wires being connected so as to give an intrusion alarm if any wire is broken.

44. A method for detecting intrusion into or tampering with contents of an enclosure, characterised by providing at least one gas proof seal-barrier in association with the enclosure, producing a first environment within said gas proof seal-barrier, said first environment being different regarding at least one characteristic feature from a second environment surrounding said gas proof seal-barrier, arranging at least one detector within said gas proof seal-barrier for detecting a predetermined change of the characteristic feature of the said first environment, transferring irrevocably said detector from a first state to a second state when there is a predetermined change of the characteristic feature, and storing within said gas proof seal-barrier at least one time stamp indicating when a change has occurred.

* * * * *